United States Patent [19]

Kamp

[11] 4,273,550

[45] Jun. 16, 1981

[54] METHOD FOR PRODUCING A FLAT BOTTOM PLASTIC BAG

[75] Inventor: Ewald A. Kamp, Chicago, Ill.

[73] Assignee: Union Carbide Corporation, New York, N.Y.

[21] Appl. No.: 71,199

[22] Filed: Aug. 30, 1979

Related U.S. Application Data

[63] Continuation of Ser. No. 889,915, Mar. 24, 1978, abandoned.

[51] Int. Cl.[3] ..... B31B 1/42; B31B 1/54; B31B 1/80

[52] U.S. Cl. ..... 493/240; 493/244; 493/256; 493/267

[58] Field of Search ..... 93/35 SB, 35 R, 32, 93/84 FF, 84 TW

[56] References Cited

U.S. PATENT DOCUMENTS

| | | | |
|---|---|---|---|
| 407,813 | 7/1889 | Burdick | 93/32 |
| 503,810 | 8/1893 | Stanley | 93/32 |
| 711,369 | 10/1902 | West | 93/32 |
| 715,360 | 12/1902 | Dulin | 93/32 |
| 2,412,501 | 12/1946 | Gardner | 93/35 SB |
| 3,606,822 | 9/1971 | Platz et al. | 93/35 SB |
| 3,669,347 | 6/1972 | Platz et al. | 229/58 |
| 3,799,042 | 3/1974 | Platz et al. | 93/35 SB |
| 3,886,850 | 6/1975 | Cole | 93/35 SB |
| 3,896,709 | 7/1975 | Brinkmeier | 93/35 SB |
| 3,967,544 | 7/1976 | Brock et al. | 93/35 SB |

FOREIGN PATENT DOCUMENTS

| | | | |
|---|---|---|---|
| 684890 | 12/1952 | United Kingdom | 93/35 SB |

*Primary Examiner*—James F. Coan
*Attorney, Agent, or Firm*—John C. Le Fever

[57] ABSTRACT

A flat-bottom bag is produced from a heat sealable tubular material having gusseted sides by clamping front and back walls in a central longitudinal region, flaring the gussets outward to about 180° to provide a corner gusset tuck and refolding the gussets to their original position with the corner tucks in position between the gussets.

3 Claims, 11 Drawing Figures

FIG. 7
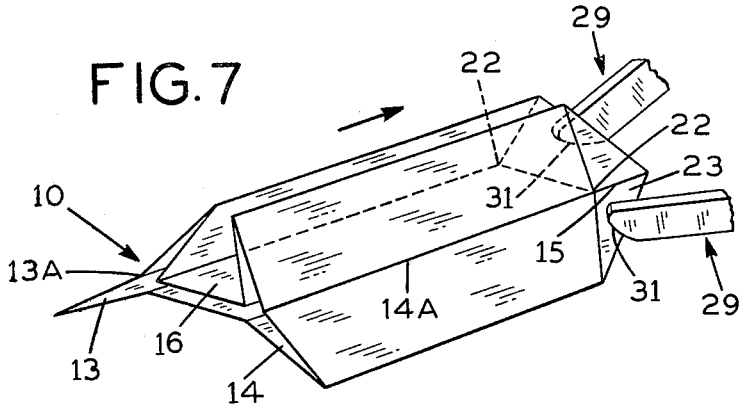
FIG. 7A
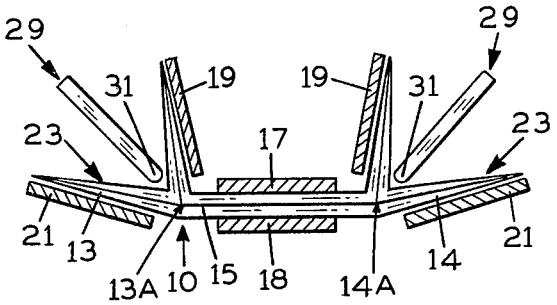
FIG. 8
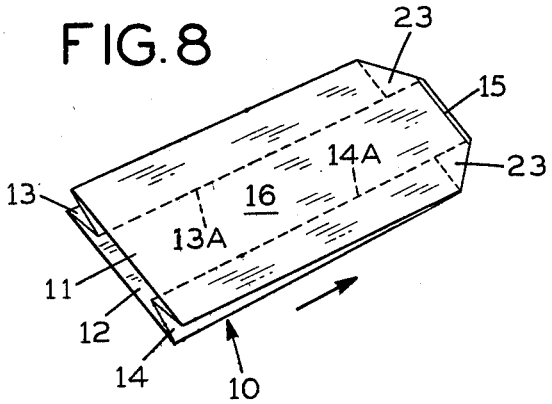
FIG. 9
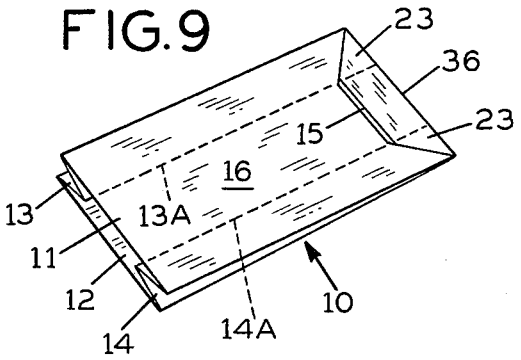
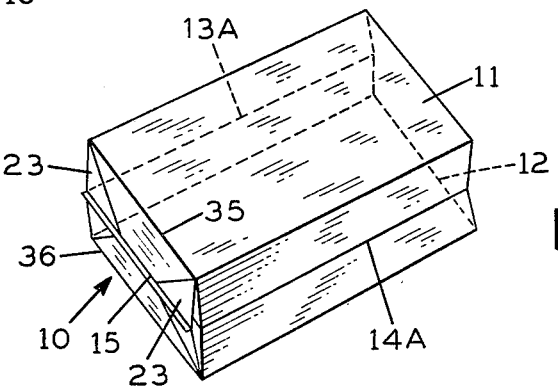
FIG. 10

METHOD FOR PRODUCING A FLAT BOTTOM PLASTIC BAG

This application is a continuation of our prior U.S. application: Ser. No. 889,915 Filing Date Mar. 24, 1978, and now abandoned.

The present invention relates to a new and useful improvement in the method of forming side gusseted square bottomed stand-up bags. More particularly the present invention relates to a method for forming a side gusseted square bottomed stand-up bag fabricated from suitable thermo plastic material having inherent heat-sealing characteristics, such as polyethylene, polypropylene, and the like.

The advent of relatively low cost plastic film has not gone unnoticed, and in fact, plastic film has been utilized to fabricate plastic bags in areas conventionally dominated by paper and similar materials. For example, plastic bags have found such use as grocery bags, shopping bags, garbage bags, and coat bags, either disposable or semi-durable. Various types of bag constructions and methods have been proposed in the patent literature. Merely as illustrative, the following U.S. Patents disclose various methods and bag constructions. U.S. Pat. Nos. 3,980,225; 3,855,907; 3,023,679; 3,606,822 and 3,669,347. Other patents in the field include U.S. Pat. Nos. 3,690,221; and 3,590,698. The type of bag constructions included in the above patents fall generally into two categories, i.e., those which do not form square corners by themselves such as Johnson, U.S. Pat. No. 3,855,907 or Kan, U.S. Pat. No. 3,980,225; or those which emulate the "paper sack" but vary in their closure method. The present invention is particularly concerned with flat bottom self-standing plastic bags such as disclosed for example in U.S. Pat. No. 3,606,822 and U.S. Pat. No. 3,669,347.

Heretofore prior art methods for forming square bottomed plastic bags have utilized "paper sack" technology. The "paper sack" technology when applied to plastic bags made from plastic film is generally complex. I have discovered a simple and efficient method for forming a square bottomed bag and conventional plastic bag making equipment can be utilized for the method with only simple modifications to the conventional equipment. The method utilizes a side gusseted tube such as conventionally manufactured by almost all tubular film extruders. Alternatively, such a tube could be produced by folding and heat-sealing flat sheets along the side. The tube is thereafter carried through a conventional "bag maker" such as manufactured by numerous commmercial firms. Only slight changes need be made to the conventional bag making machine to make it adaptable for connection to a unit for in-tucking the corner bag gussets to form a square bottom bag.

It is therefore a major object of the present invention to provide a method for generating a side gusseted squared bottom plastic bag.

It is an additional important object of the invention to provide a bag of the character under discussion which may be produced with particular economy, can compete successfully with prior-art paper bags and can be used with particular facility in grocery and supermarket operations and the like.

Still another object of the invention is to provide a method for forming a side gusseted self-standing square bottomed plastic bag wherein no contact adhesives, tapes, patch additions or hot melt adhesives are required during fabrication.

These and other objects of the invention will become apparent from the description taken in conjunction with the accompanying drawings in which.

Figure 2:
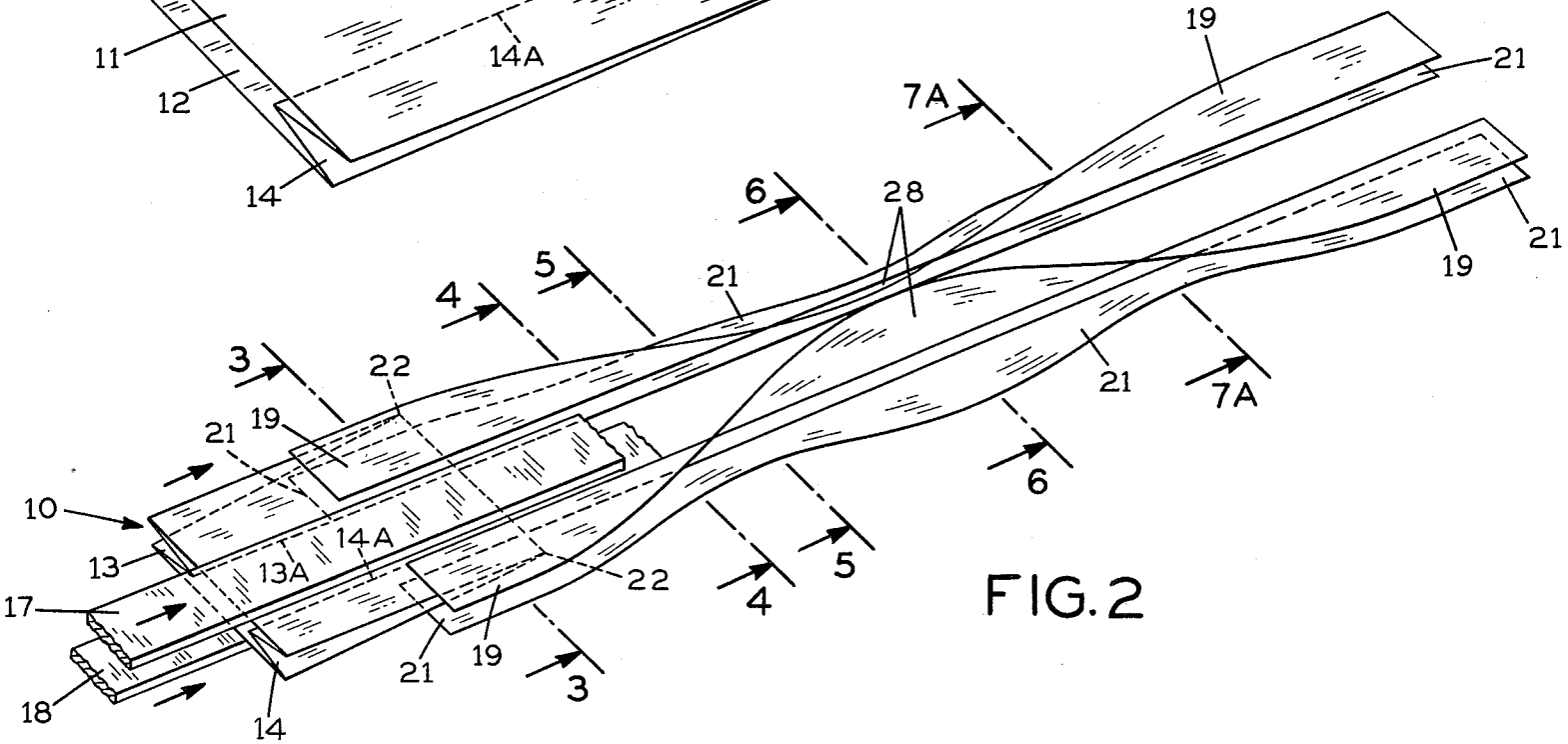
FIG. 2 is a view illustrating the first step in generating the flat-bottom plastic bag of the present invention, i.e., clamping the front and back walls in a central longitudinal region and illustrates one form of clamping mechanism operable to clamp the front and back walls and to advance the bag and also illustrating stationary sheet metal guides above and below the side gussets.
Figure 3:
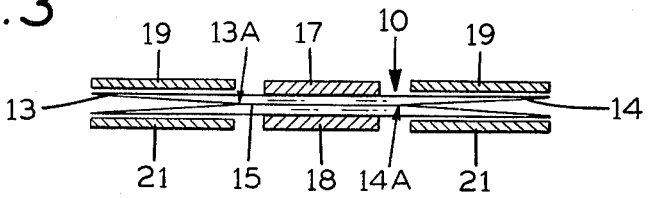
FIG. 3 is a view taken along the lines 3—3 of FIG. 2.
Figure 5:
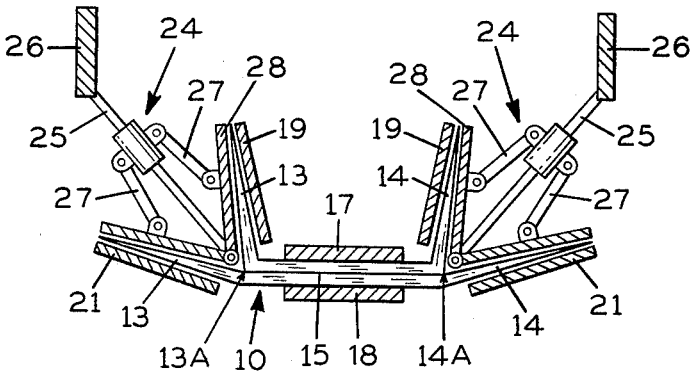

FIG. 5 is a view taken along line 5—5 of FIG. 2 and showing one position in the gradual spreading of the side gussets from 0° towards 180° and illustrating one form of a spreader mechanism operable to gradually spread the gussets as the bag and spreader is advanced.

Figure 6:
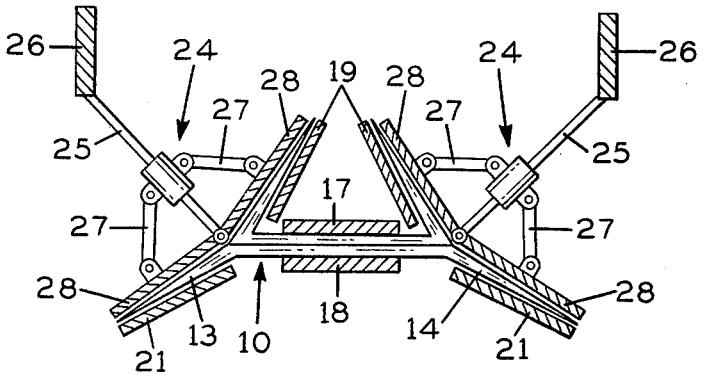

FIG. 6 is a view taken along line 6—6 of FIG. 2 showing the further unfolding of the spreader mechanism and the resultant opening of the side gussets towards a flat configuration;

FIG. 7 is an isometric view of the plastic envelope shown in FIG. 6 with the gussets fully flared (omitting the clamping mechanism, the sheet metal guides and spreader mechanism from the view) to provide a hood or triangular tuck on the sealed end and showing the gusset fold line and transverse seal in juxtaposition and further showing one form of mechanism, i.e., a stationary plow to aid in holding the triangular tuck in position;

FIG. 7A is a view showing the gusset being refolded towards 0°;

FIG. 8 is an isometric view of the plastic envelope with the side gussets returned to their original position thereby providing inwardly folded corner tucks;

FIG. 9 is a view similar to FIG. 8 but showing the creasing of the bag at the terminal ends of the seal to form creases as a means for defining the periphery of the bottom of the bag; and FIG. 10 is a view showing a fully opened bag made in accordance with the method of the instant invention.

Broadly contemplated, the present invention provides a method of producing a flat-bottom bag from thermoplastic material which includes the steps of:

(a) providing a length of flattened, heat sealable tubular material having front and back walls and united along each longitudinal edge by a gusset including a longitudinal gusset fold line, said length having been heat sealed transversely adjacent one extremity to provide a bag having a closed bottom and an open mouth;

(b) clamping the front and back walls in a central longitudinal region;

(c) flaring the gussets until the position of the transverse heat seal common to the gusset coincides with the gusset fold line;

(d) and maintaining the fold line and heat seal in juxtaposition while returning the gussets to the non-flared position thus providing a gusset tuck on each corner of said closed bottom.

Optionally a line can be generated transversely at the terminal ends of the seal to form creases for defining the periphery of the bottom of the bag.

Figure 1:
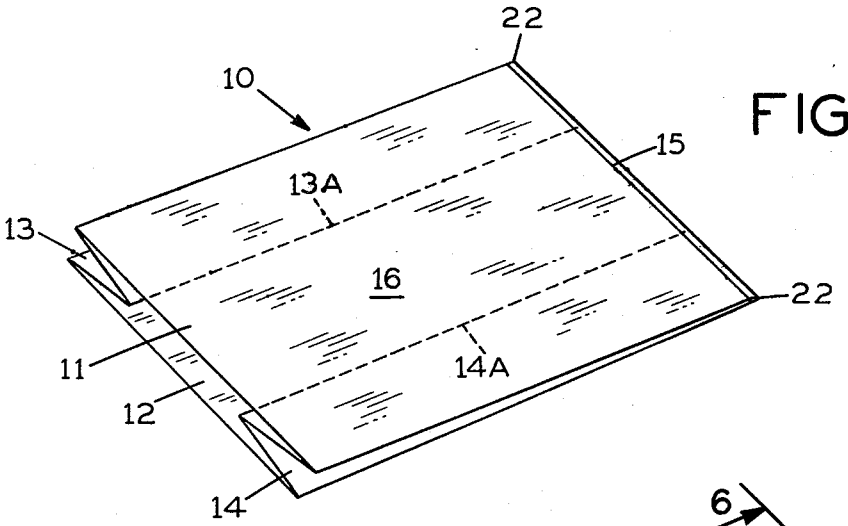
FIG. 1 is a perspective view of a partially opened plastic envelope produced from an extruded length of thermoplastic seamless tubing having a gusset in each longitudinal edge thereof and heat sealed transversely across the full width thereof, including the opposed gussets, to provide a sealed bottom edge.

For a clearer understanding of the invention reference is made to the drawing and particularly to FIG. 1 which illustrates a tube which has been heat sealed transversely along the bottom edge to form a bag 10 after being severed from a length of seamless thermoplastic tubing produced by an extrusion process and flattened as is well known in the art. The severed bag includes a front wall 11 and a rear wall 12 united along the longitudinal edges thereof by gussets 13 and 14, the latter being folded around gusset fold lines 13A and 14A respectively. The thermoplastic material is heat sealed transversely, from edge to edge thereof as indicated at heat seal line 15 and severed immediately beyond the seal 15, thereby providing a bottom closure for the initial bag and an opened mouth edge for the next adjacent bag, the invention contemplating the successive production of bags from a continuous length of tubing. It will be noted that the transverse heat seal 15 securely unites or welds the bottom edges of the front and rear walls or panels 11 and 12 to each other and that this seal also includes the gusseted portions 13 and 14. Thus, in the central portion of the seal tube there are 2 layers of thermoplastic material, constituting the front and rear walls of the bag; however, in the marginal portions of the seal 15 there are 4 layers of thermoplastic material, the 2 opposed layers forming each gusset 13 and 14 being sealed to each other and between the front wall 11 and the rear wall 12.

The seal 15 constituting the bottom closure can be produced by numerous methods known in the art, including hot wire or hot knife cut-off seals, stationary or traveling bar seals, traveling heating bands, rotary discs, or ultrasonic sealers. The significant result should be a strong, leak tight seal.

The material for the bag could be any one of a variety of plastics, e.g., high or low density polyethylene or blends thereof, polyvinyl chloride, polypropylene, ethylene-ethylacrylate, polyvinylacetate, or a variety of laminates such as different polymeric films, paper extrusion coated with polymers, scrim reinforced structures, coated textiles or nonwovens, etc.

As the bag travels through the bag machine, it can travel with either the open or sealed end leading. The latter is preferred however, since the open end could scoop up air which would be trapped causing later processing difficulties.

Referring again to FIG. 1, it will be seen that the heat sealed bag has a central zone 16. The method of the instant invention requires that the central zone 16 of the front and back walls be held firmly in order to prepare for the next operation. The front and back walls can be held firmly or clamped by directing the bag between two feed belts of somewhat lesser width than the central zone 16. Thus referring to FIG. 2 it will be seen that two such feed belts are shown and designated as upper feed belt 17 and lower feed belt 18 driven by a power source (not shown) and that the tubular bag is directed between the two feed belts so that the central zone 16 of the bag is clamped between the feed belts. The belts preferably have a roughened surface to provide a more secure grip such as molded conveyor belting and can also be optionally provided with pressure rolls (not shown) to increase the holding power. Various other techniques can be utilized which can serve an equivalent function such as power roller beds, vacuum caps, etc. Whatever device or technique is utilized, it should be sufficient to clamp the bag in the designated area and also serve as a means to transport the bag through the subsequent method steps.

Figure 4:
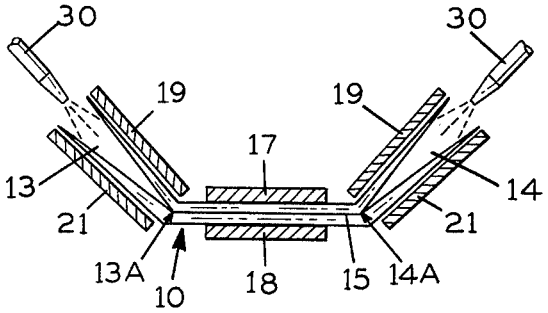
FIG. 4 is a view taken along line 4—4 of FIG. 2 and also illustrating an air jet to assist in unblocking the film.

As best seen from FIGS. 2, 4, 5 and 6, the bag 10 travels in between upper and lower stationary guides 19 and 21 respectively attached to a gusset tucker unit and which are disposed above and below each gusset 13 and 14. The stationary guides which can be fabricated from plastic or metal are adapted to define a path conforming means corresponding to the flaring of the gussets toward a nominal 180° and a subsequent refolding. The nominal 180° could be more than 180° or less than 180° depending upon the modulus and resiliency of the polymers used in the bag construction; however, experiments indicate no commercial materials were found to require more than ±25° from the nominal. The opening to the nominal 180° of the side gussets under suitable restraint, forces the corners 22 of the second end 15 to adapt to the dimensional restraints and forms a "hood" or a triangular tuck 23 disposed on each side of the bag (FIG. 7) whereby the transverse heat seal 15 common to the gussets coincides with the gusset fold lines 13A and 14A respectively. In order to aid in the outward flaring of the gussets and to urge the gussets towards the conforming means, i.e., upper and lower stationary guides 19 and 21, use is made of a spreader mechanism. Various types of spreader mechanisms can be utilized for the intended purpose and merely as illustrative FIGS. 5 and 6 illustrate one such type mechanism by reference numeral 24. The spreader mechanism illustrated in FIGS. 5 and 6 is an umbrella type linkage device which can be activated by cams or small fluid controlled devices (not fully shown) and is designed to travel along with the bag during its spreading motion, i.e., the outward flaring of the side gussets. The umbrella type linkage device is attached to a corner tucking unit and includes member 25 extending from support 26 and which slideably accommodates pivot arms 27. Pivot arms 27 are adapted to urge plates 28 either towards or away from the confronting surfaces of upper and lower stationary guides 19 and 21 thereby causing gussets 13 and 14 sandwiched in between plates 28 and stationary guides 19 and 21 to follow a path defined by the surface of the stationary plates. Prior to contacting the gussets with the spreader mechanism, however, the gussets may be "sticking to each other" as a result of chemical interaction or electrostatic forces caused by unwinding film from a roll, and in order to overcome any blocking tendency of the films it is sometimes desirable to have a power assist to separate the film such as a vacuum lift or an air jet. Thus, as shown in FIG. 4, air jet 30 is disposed in a manner such as to be capable of delivering a jet of air in between the inner confronting surfaces of gussets 13 and 14 so that the inner confronting surfaces can be separated to permit subsequent contact with the plate 28 of the spreader mechanism 24.

As the gussets are forced into their outwardly flared position, as shown in FIG. 7, a hood or triangular tuck 23 is formed at each lower corner of the bag. At this point the transverse heat seal line 15 common to the gusset and front wall and rear wall coincides with gusset fold line 13A and 14A. The tuck 234 now must be held in this position while the gussets are refolded with the triangular tucks 23 sandwiched in between. As shown in FIG. 7, a stationary plow 29 is provided to hold the tuck while effecting return of the gussets to their original starting position. Plows 29 are mounted to contact each side of gusset 13 and 14 so that the contacting edge 31 applies sliding pressure to the gusset fold lines 13A and 14A and to the heat seal line 15 which coincides with gusset fold lines 13A and 14A. As the bag travel continues and the gussets are returned to the non-flared condition by action of the upper and lower stationary plates (as shown in FIG. 7A), the resultant bag, shown in FIG. 8 is produced. As will be seen from FIG. 8, the gussets have been refolded thus maintaining the triangular tucks or hood 23 trapped within the gusset.

After the bag, as shown in FIG. 8., is produced, it is desirable that the bag thereafter be directed through a creating operation. Additionally it is highly desirable to generate a transverse crease or fold line on the bag (in some materials also called score line). This transverse line should be near the widest point of the corner tucks or at the terminal ends of the seal. The crease or fold line could be produced by numerous conventional devices including pressure blades or rolls. A simple way to implement a crease or fold line is illustrated in FIG. 9 wherein a fold over of the bag end defines a trapezoidal bottom portion of the bag which could be produced by a folding bar in conjunction with a set of pressure rolls. The transverse fold line together with the corners now defines a square bottom bag after opening.

In a typical mode of operation and with reference to the accompanying drawing, a tube formed from a length of seamless thermoplastic tubing produced by an extrusion process has been sealed transversely along the bottom edge to form a bag 10. The bag so formed on a continuous bag making machine is directed between feed belts 17 and 18 of somewhat lesser width than the central zone 16 of the bag. The upper and lower feed belts serve to clamp the bag in the central zone and direct the bag between the upper and lower stationary guides 19 and 21 respectively disposed above and below each gusset 13 and 14. The bag continues its travel with the closed end leading and streams of air are directed towards the gussets 13 and 14 from air jets 30 as shown in FIG. 4 to assist in unblocking the film. As the bag continues its travel, spreader mechanism 24 is activated and travels along with the bag during its spreading motion, i.e., the outward flaring of the side gussets. Pivotal arms 27 urge the gussets, sandwiched in between plates 28 and stationary guides 19 and 21 toward the surface of the stationary plates thereby initiating the flaring of the gussets as shown in FIG. 5. As the gussets are fully spread as shown in FIG. 6 stationary plows 29 shown in FIG. 7 apply sliding pressure along gusset fold line 13A and 14A and to the triangular tucked-in corners or hood 23 formed by flaring the gussets as explained previously and as shown in FIG. 6. As the bag continues its advance the gusset folds begin to return to their original folded position as a result of the action of stationary guides 19 and 21. The spreader mechanism 24 folds and returns to enter and flare the gusset of the next bag. The bag with the gussets refolded and the corners tucked in as shown in FIG. 8 continues its travel through a pair of nip rolls or other pressure device (not shown) to form permanent creases in the tucked-in triangles 23 of the bag. Thereafter the bag proceeds to a scoring or creasing operation transversely applied across the terminal ends of the seal to form the creases 35 and 36 for defining the periphery of the bottom of the bag as shown in FIG. 10. Alternatively the bag can be transversely folded at the terminal ends of the seal to form the creases 35 and 36 for defining the periphery of the bottom of the bag as shown in FIG. 9. The bag can thereafter be directed to a conventional palletizer or alternatively it can be directed to a conventional carton folder where the bags are folded and packed in a carton. A view of an opened bag produced by the method of the present invention is shown in FIG. 10.

It will be obvious to those skilled in the art that various changes may be made in the invention without departing from the spirit and scope thereof. Thus, the invention is not considered limited by that which is shown in the drawings and described in the specification and reference is had to the claims for summaries of the essentials of the invention, novel features of construction, and novel methods of operation, for all of which protection is desired.

What is claimed is:

1. A method of producing a flat-bottom bag from a thermo plastic heat sealable material which includes the steps of:

(a) providing a length of flattened, thermo plastic heat sealable tubular material having front and back walls and a central longitudinal region, said walls being united along each longitudinal edge by a gusset including a longitudinal gusset fold line, said length having been heat sealed transversely adjacent one extremity to provide a bag having a closed bottom and an open mouth;

(b) clamping the front and back walls in said central longitudinal region by directing said bag between two feed belts of lesser width than said central region;

(c) delivering a jet of air in between each of said gussets to separate opposing films of said gussets from each other;

(d) flaring the gussets until the position of the transverse heat seal common to the gusset coincides with the gusset fold line by directing a continuous force against said gussets while passing said gussets through a first path-conforming zone corresponding to the spreading of the gussets from substantially 0° to substantially 180°; and (e) maintaining the fold line and heat seal in juxtaposition by application of a force directed against said fold line and said heat seal while returning the gussets to the non-flared position by directing said gussets through a second path-conforming zone corresponding to the merging of the gussets from substantially 180° to substantially 0° thus providing a gusset tuck disposed on each corner of said closed bottom.

2. A method according to claim 1 further including after step (e) the step (f) of transversely generating a scoring line across the bag at the terminal ends of the seal to form creases for defining the periphery of the bottom of the bag.

3. A method of producing a flat-bottom bag from a heat sealable material which includes the steps of:

(a) providing a length of flattened, heat sealable tubular material having front and back walls and a central longitudinal region, said walls being united along each longitudinal edge by a gusset including a longitudinal gusset fold line, said length having been heat sealed transversely adjacent one extremity to provide a bag having a closed bottom and an open mouth;

(b) clamping the front and back walls in said central longitudinal region by directing said bag between two feed belts of lesser width than said central region;

(c) delivering a jet of air in between each of said gussets to separate opposing films of said gussets from each other;

(d) flaring the gussets until the position of the transverse heat seal common to the gusset coincides with the gusset fold line by directing a continuous force against said gussets while passing said gussets through a first path-conforming zone corresponding to the spreading of the gussets from substantially 0° to substantially 180°;

(e) maintaining the fold line and heat seal in juxtaposition by application of a force directed against said fold line and said heat seal while returning the gussets to the non-flared position by directing said gussets through a second path-conforming zone corresponding to the merging of the gussets from substantially 180° to substantially 0° thus providing a gusset tuck disposed on each corner of said closed bottom; and (f) transversely generating a line across the bag at the terminal ends of the seal to form creases for defining the periphery of the bottom of the bag, said line being generated by transversely folding and creasing the bag at the terminal ends of the seal.

* * * * *